US005337494A

United States Patent [19]

Ricker

[11] Patent Number: 5,337,494

[45] Date of Patent: Aug. 16, 1994

[54] SHOE WITH RETRACTABLE CLEATS

[76] Inventor: Thomas H. Ricker, 464 Hill Rd., Wernersville, Pa. 19565

[21] Appl. No.: 54,128

[22] Filed: Apr. 28, 1993

[51] Int. Cl.[5] ..... A43C 15/14; A43B 13/24

[52] U.S. Cl. ..... 36/61; 36/134

[58] Field of Search ..... 36/61, 134, 67 R, 67 D, 36/127

[56] References Cited

U.S. PATENT DOCUMENTS

| | | | |
|---|---|---|---|
| 2,920,404 | 1/1960 | Ross | 36/61 |
| 3,693,271 | 9/1972 | Korpei | 36/61 |
| 3,716,931 | 2/1973 | Loudermilk | 36/61 |
| 3,717,238 | 2/1973 | Fox | 36/61 |
| 3,793,751 | 2/1974 | Gordos | 36/134 |
| 4,271,608 | 6/1981 | Tomuro | 36/127 |
| 4,333,249 | 6/1982 | Schaefer | 36/134 |
| 4,375,729 | 3/1983 | Buchanen, III | 36/134 |
| 4,821,434 | 4/1989 | Chein | 36/134 |
| 4,825,562 | 5/1989 | Chuang | 36/134 |
| 4,873,774 | 10/1989 | Lafever | 36/61 |

FOREIGN PATENT DOCUMENTS

| | | | |
|---|---|---|---|
| 83171 | 9/1895 | Fed. Rep. of Germany | 36/61 |
| 191178 | 3/1907 | Fed. Rep. of Germany | 36/61 |
| 2046792 | 3/1972 | Fed. Rep. of Germany | 36/61 |
| 1438333 | 6/1976 | United Kingdom | 36/61 |

*Primary Examiner*—Steven N. Meyers

*Attorney, Agent, or Firm*—Caesar, Rivise, Bernstein, Cohen & Pokotilow, Ltd.

[57] ABSTRACT

A cleated shoe which includes a mechanism which allows for the cleats to be retracted when not on an activity surface and then to be lowered or extended simultaneously for better traction at the wearer's command. The mechanism consists of a control lever located at the back of the shoe and two sliding flexible plastic members disposed on top of one another longitudinally within the sole of the shoe, with the heads of a plurality of cleats trapped between these two sliding members. The head of the cleats remain within the sole of the shoe whereas the body of the cleat can be extended out of the bottom of the shoe sole or totally retracted into the sole. The top sliding member is grooved to drive and lock the cleat into retraction or extension while the lower sliding member uncovers or covers the cleat opening, respectively. The sliding members work in opposition to each other so that upon wearer displacement of the control lever toward the shoe, the upper sliding member is driven forward, forcing all cleats to retract and lock in that position while simultaneously the lower sliding member is driven backward, forcing all blocking segments to back away and allow the retracting cleat to enter the cavity. The reverse happens when the wearer pulls the control lever away from the shoe, resulting in the extension of all cleats and the covering of all cleat apertures. The apparatus as it is designed will actuate all the cleats at the same time.

11 Claims, 10 Drawing Sheets

FIG. 1
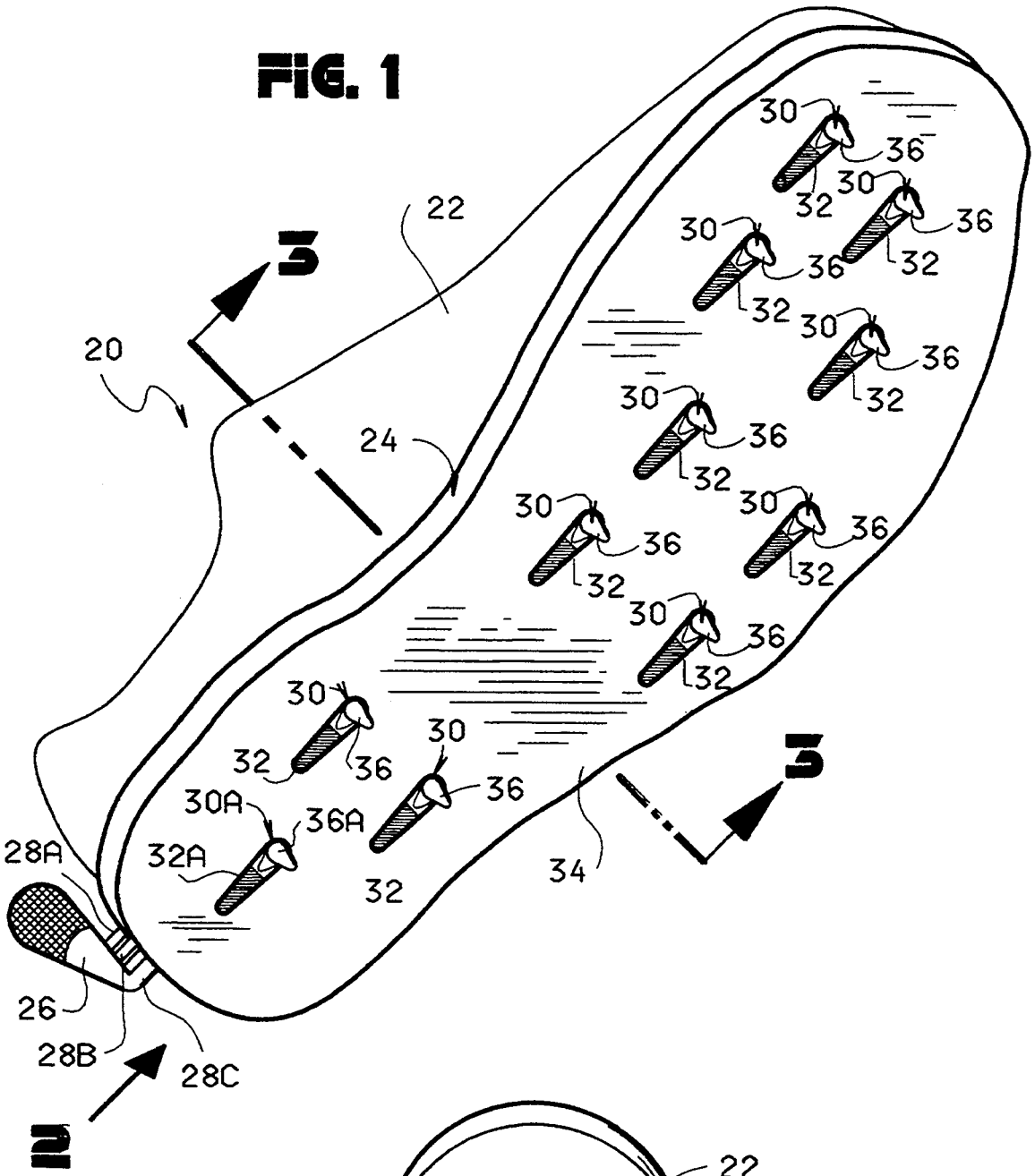
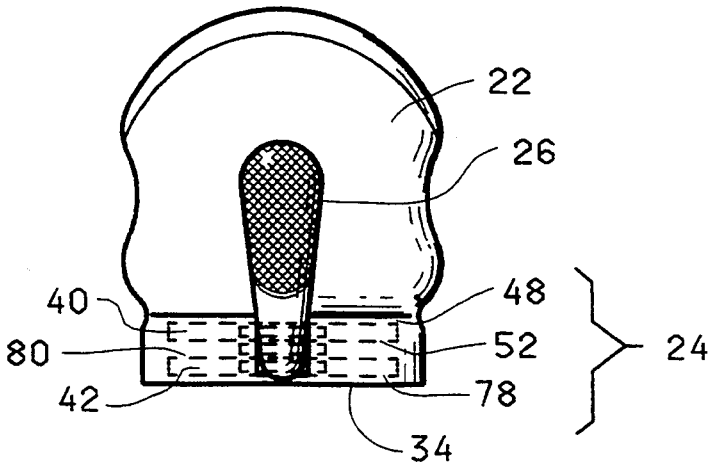
FIG. 2

FIG. 4a
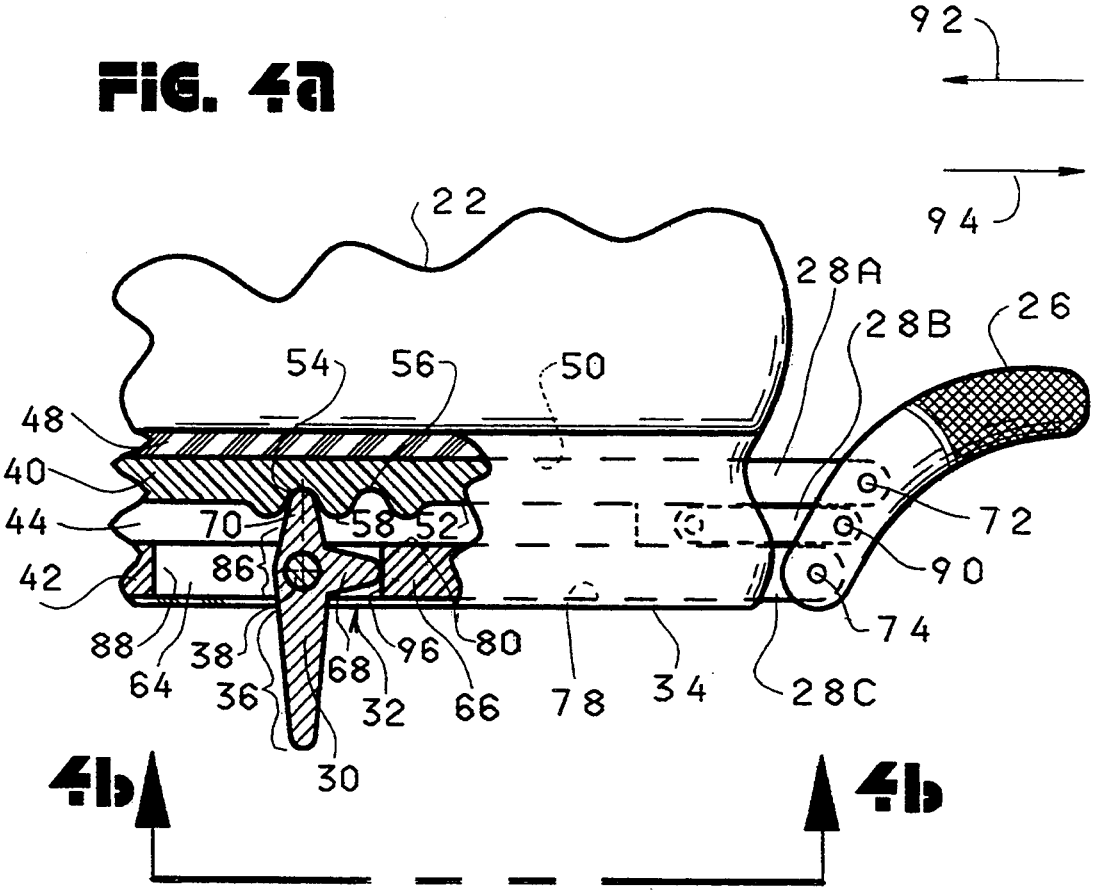
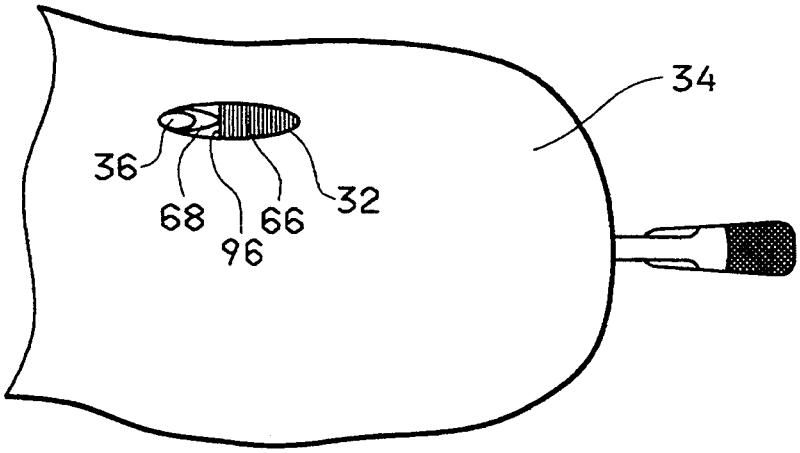
FIG. 4b

FIG. 5a
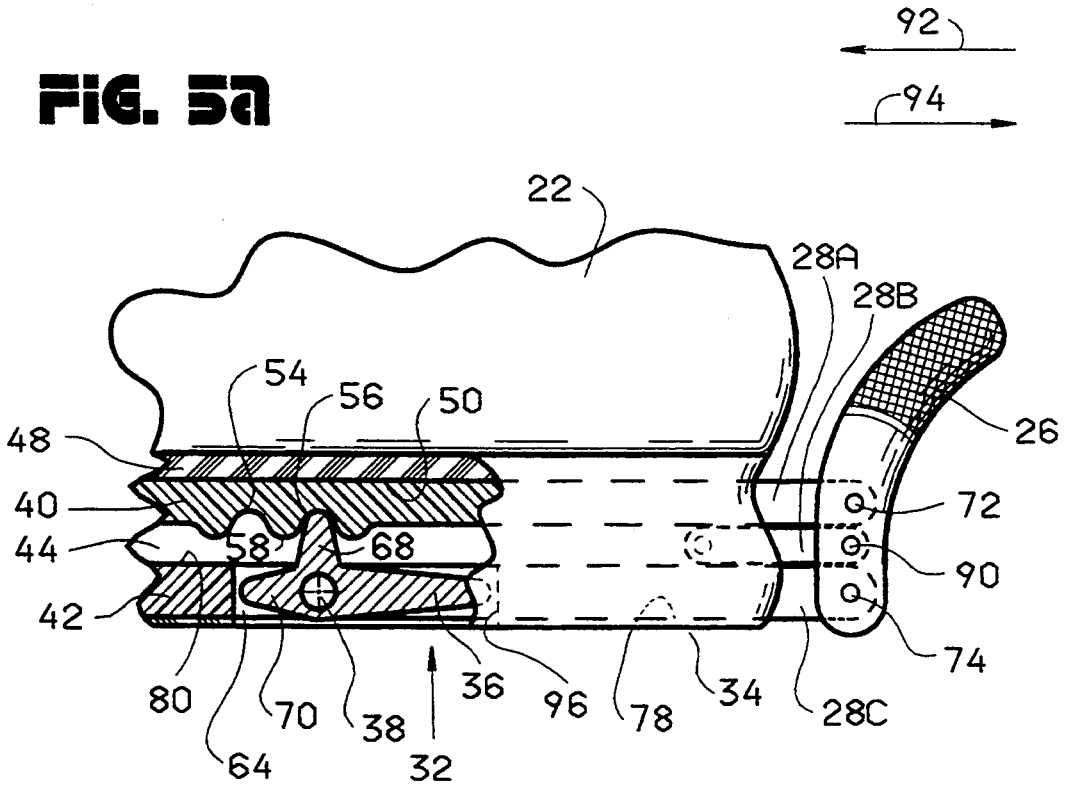
5b 5b
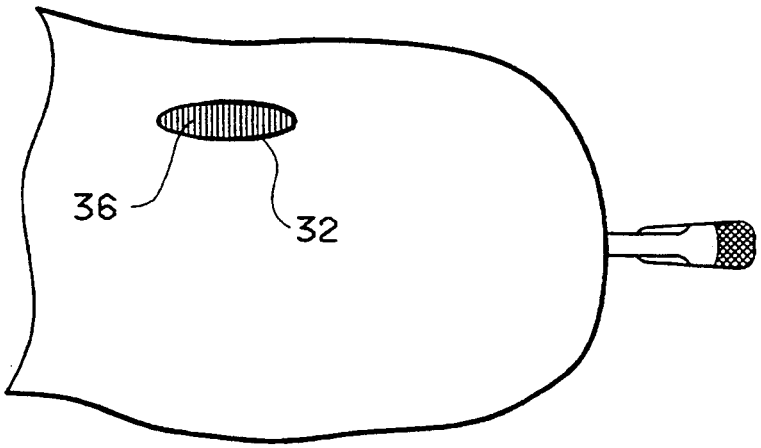
FIG. 5b

SHOE WITH RETRACTABLE CLEATS

BACKGROUND OF THE INVENTION

This invention relates generally to shoes and more particularly to shoes that can extend and retract spikes from the soles to enhance traction.

Use of cleats on the bottom of shoes to enhance traction has been known for a long time. Where the wearer may need to support his entire body weight during the activity, long cleats project from the bottoms of the shoe. Such cleated shoes are used in climbing activities such as mountain climbing, hiking, lumber and telephone pole scaling.

Cleated shoes are also used on open ground or artificially-turfed surfaces for athletics and sports activities, e.g., football, baseball, soccer, to help enhance traction during running and turning. The cleats also act to help anchor one's footing when the wearer is trying to maintain a stationary position e.g., swinging a golf club or baseball bat or blocking an opponent with one's body during a football game.

Cleated shoes are also used on surfaces exposed to the elements where ice and snow may form and the wearer wants to avoid slipping or sliding when walking.

Some cleated shoes function solely for the purpose of preventing the heel or sole from wearing down during use; i.e., because the cleat projects outward from the sole, the cleat engages the ground during wear instead of the sole or heel.

However, it is also desirable to be able to eliminate the cleats once the need for them is gone, e.g., when the wearer enters an enclosure that has a floor where the cleats are no longer needed and may even damage the floor once the wearer walks on this surface with the cleats projecting. The solution has been to make such cleats either removable or retractable so that the wearer can wear the shoe in almost any environment and can control when the cleats will or will not project from the sole.

The following constitute examples of various types of prior art retractable cleat shoes found in the following U.S. Pat. Nos.: 48,943 (Hodgins); 264,105 (Rust); 1,071,147 (East); 3,343,283 (Henry); 3,716,931 (Loudermilk); 3,793,751 (Gordos); 4,375,729 (Buchanan, III); 4,825,562 (Chuang); 4,821,434 (Chein) .

The apparatus disclosed by Hodgins is a device embedded within the heel of a shoe that the wearer can manually adjust to compensate for any worn-down portion of the heel and maintain an even heel. The device uses two horizontally sliding surfaces with corresponding sawtooth edges to regulate the amount of cleat projection necessary to maintain heel height. With the cleats entirely recessed in the heel, the two horizontal surfaces' teeth members fit securely together. As the upper horizontal surface is pushed out of alignment with respect to the lower surface, the lower surface is driven downward by the upper surface teeth. The amount that the lower surface is driven downward corresponds to the amount of cleat projection. Two screws protruding from the front of the heel adjust the height of the cleat and lock the cleat in place respectively.

The apparatus disclosed by Rust is also a device embedded in the heel but is used to provide better traction on the ice. The device also uses two horizontally sliding surfaces with a ratchet surface interface to drive the cleats in or out of the heel. There is no adjustment of the cleat height since it is either recessed within the heel or projecting out from the heel. The Rust apparatus is controlled by a projecting bar that is directly attached to the upper surface. The wearer can strike the cross-sectional end of the bar against any hard surface to either project the cleat (and thereby lock the cleat in place) or unlock the cleat (and thereby retract the cleat into the heel).

The apparatus disclosed by East is a device that uses an "L-shaped" pivoting member to act as both a cleat and as a cover to prevent foreign matter from entering the aperture from which the cleat emerges. The East device is disposed within the heel of the shoe and uses several overlaid plates with apertures through which the "L-shaped" members pivot. By manipulating the several plates with respect to one another using a sliding tab protruding from the heel, the "L-shaped" member pivots about its corner. With the tab pushed to one extreme setting the cleat is locked in a downward position while the aperture from which it came is covered by the other portion of the "L-shaped" member. Pushing the tab to the other extreme position pivots the cleat upwards into the apertures with the cleat itself now acting as a cover to prevent foreign matter from gaining access into the apertures.

The device disclosed by Henry is a retractable anti-slip device for shoe heels also. A torsion spring/flange assembly is embedded in the heel and is activated by a key inserted into a cavity within the heel. Turning the key in one direction forces two cleats to emerge from the heel and are thereby locked into position by a trapped crank arm within a groove while torsioning the spring. Turning the key in the other direction removes the crank arm from the groove and the spring becomes unloaded as the crank arm is pulled upwards by a retraction flange and thereby retracting the cleats into the heel.

The device disclosed by Loudermilk is a retractable cleat assembly, a multitude of which, are mounted within a base that is then attached to the sole of a golf shoe, including the golf shoe heel. The retractable cleat assembly design utilizes a cleat that pivots within a rectangular receptacle. With each receptacle mounted in the sole and the shoe turned over, the cleat remains in a retracted state. A receptacle cover, with a hole that allows the extended cleat to protrude from, fits snugly over the receptacle to prevent foreign matter from entering the receptacle once the cleat is in an extended state. When the cleat is in a retracted state, a small plug fills the hole in the cover to keep out foreign matter. To extend the cleat, an independent magnet- formed into a "U" shape to permit the protruding cleat to pass between the two sides of the magnet when it lies flush with the receptacle cover- is brought into contact with the metallic receptacle cover. As the magnet/cover assembly is removed from the receptacle, the metallic cleat is attracted from its retracted position within the receptacle and pivots into its fully extended position. The magnet/cover assembly is then pressed back onto the receptacle, with the cleat passing through the hole in the cover and between the magnet's two sides. The magnet is then removed from the cover and this procedure is repeated for each retractable cleat assembly. To retract the cleat, the cover is pulled off from receptacle and the cleat is forced down into the receptacle. The cover is then forced down over the receptacle and the small plug is inserted to close off the cleat hole in the cover. A multitude of these retractable assemblies are permanently mounted in as many layers of sole material as necessary to yield sufficient cleat penetration into the ground when extended. These sole layers are themselves then permanently mounted to the shoe sole.

The device disclosed by Gordos retracts or extends cleats from a golf shoe by means of a protruding knob at the heel of the shoe which rotates a flexible cam shaft that runs longitudinally within the sole of the shoe. The flexible cam shaft allows the use of a shaft from toe to heel within a shoe while not relinquishing the shoe's usual contour of the foot arch. A plurality of cleats are mounted in a cleat plate that moves up and down within a space within the shoe sole. Straps are mounted to the cleat plate which pass over the cam shaft at specific locations. When the knob is rotated, a cam- located on the shaft where these straps are mounted- engages the strap and thereby lifts or releases the strap causing the cleat plate to either retract or extend the cleats respectively.

The device disclosed by Buchanen III allows the control of cleats emanating from sole of the shoe to be accomplished without the use of an external controlling mechanism, i.e., the control mechanism is also embedded within the shoe. The cleats are mounted to a flexible material that forms a snug fit with the tread material. The tread material contains several apertures through which the cleats emanate. A sliding cam member presses the flexible material against the tread surface forming a watertight seal so that any foreign matter that enters the aperture within the tread has no access within the shoe. The cam member is designed such that it normally "dimples" the flexible material where a cleat is attached and thereby the cleats are held in a recessed position. When the cam member is driven backward, it presses down on the flexible material forcing the cleat out through the tread aperture, thereby extending the cleat. The cam member locks in that position and thereby closes off the aperture from any foreign material while locking the cleat in an extended position. Sliding the cam member forward causes the flexible material to "dimple," thereby retracting the cleats while maintaining a snug fit with the tread and thereby preventing foreign matter from getting into shoe. The cam member is controlled by two springs mounted perpendicular to one another within the heel. The springs are locked when associated slide members engage internal grooves. Pressure applied to the back right side of the shoe locks and unlocks the springs to achieve cleat retraction or extension.

The device disclosed by Chuang allows for the extension or retraction of elastic cleats from a shoe to be used on the ice and snow by turning a key accessed from within the shoe itself. There are two independent nail sets, a group of cleats that are mounted to a common member, in the front and heel of the shoe. Each nail set is normally positioned in a retracted position, with the cleats aligned with holes in tread from which the cleats will protrude when extended. A sliding member, when driven backward toward the heel, forces each nail set downward causing them to extend and to be locked in that position. The sliding member is controlled by a disk mounted inside the shoe and covered by the insole. On the underside of this disk is a pin that fits within a slot in the sliding member. When the disk is rotated, the pin forces the sliding member either backward or forward, depending in which direction the disk is rotated. A backward movement forces the nail sets downward, extending the cleats; a forward movement removes the downward force and permits the cleats to be pushed up into the sole of the shoe unopposed. To rotate the disk, the wearer must remove the shoe and then remove the insole thereby uncovering the disk.

The device disclosed by Chein is a shoe structure with nails to extend or retract in by kicking forwards or backwards. This device combines the Hodgins and Rust teachings of sliding members that force the cleats out when two surfaces slide with respect to one another; this device also incorporates the Buchanan III teaching of having no external member controlling the retraction/extension functions. In the Chein device, the wearer simply kicks the toe of the shoe against a hard surface to extend the cleats while kicking the heel against a hard surface to retract the cleats.

Although much of the discussed prior art concerns cleats that move vertically, i.e., up for retraction and down for extension, such prior art does not disclose means and methods for easily and effectively covering up the cavity remaining in the shoe tread when the cleat is retracted. Moreover, a means to keep dirt, ice, water and other foreign matter out of the cavities from which the cleat emerges and into which they recede is lacking in the prior art except for the East patent provides a method for covering the aperture once the cleat is retracted. However, East's device and method of operation does not simultaneously cover all cleat apertures throughout the entire length of the sole. Rather, the East disclosure is restricted to transversely-located, rotatably retractable heel cleats.

Many of these retractable shoe designs make the shoes heavy to wear or are bulky.

Two of these of shoe devices require the removal of the shoe in order to retract or extend the cleats.

OBJECTS OF THE INVENTION

It is a general object of this invention to provide an apparatus which overcomes the disadvantages of the prior art.

It is another object of this invention to provide a shoe with retractable cleats such that the apertures through which the cleats emerge from, or retract into, are simultaneously covered to prevent the entry of foreign materials by contact with the ground during wear.

It is still another object of this invention to provide the wearer with a simple means to extend or retract all cleats simultaneously without having to remove the shoe or without having to reach into a recessed area of the shoe to achieve extension or retraction of all cleats.

It is still another object of this invention to provide the wearer with a simple means to block the apertures of all cleat apertures simultaneously without having to remove the shoe or without having to reach into a recessed area of the shoe to achieve blockage of all cleat apertures.

It is still another object of this invention to lock the retractable cleats in either the extended or retracted state.

It is yet another object of this invention to provide a light-weight cleated shoe.

SUMMARY OF THE INVENTION

These and other objects of the invention are achieved by providing a shoe having a sole means, a plurality of apertures, a plurality of ground engaging members, and a common control means. The sole means has a longitudinal axis with a plurality of apertures being located in the sole means, and with the apertures being elongated and longitudinally directed. The plural ground engaging members are located within respective apertures and are pivotally mounted for movement in a first longitudinal direction to an extended position where these ground engaging members project out of the apertures to engage the ground. The ground engaging members are also pivotally mounted for movement in a second and opposite longitudinal direction, to a retracted position, where the members are located to fill at least a substantial portion of the openings from the ingress of foreign matter therein. A common control means operates to move the plural ground engaging members in unison to either the first or second position.

DESCRIPTION OF THE DRAWINGS

FIG. 1 is an isometric view of an athletic shoe embodying the subject invention;

FIG. 2 is a reduced-rear view of the back of the shoe shown in FIG. 1;

FIG. 4*a* is a side elevation view, partially in section, of the rear portion of the shoe of FIG. 1 showing one cleat in its extended position;

FIG. 4*b* is a bottom view, looking at the shoe tread, of FIG. 4*a*;

FIG. 5*a* is a view like that of FIG. 4*a* showing the cleat in its retracted position;

FIG. 5*b* is a bottom view, looking at the shoe tread, of FIG. 5*a*;

DETAILED DESCRIPTION OF THE PREFERRED EMBODIMENT

Figure 3:
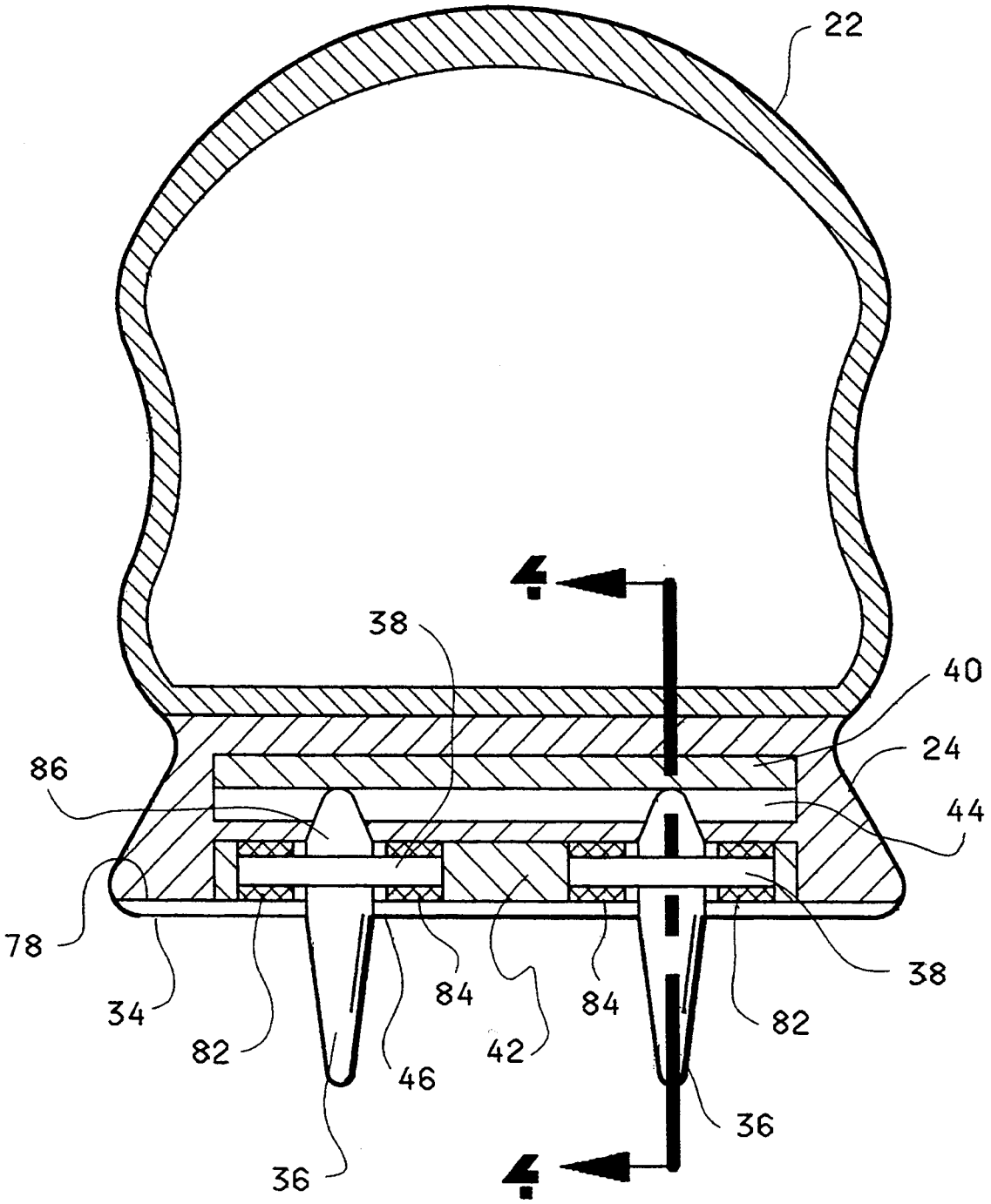
FIG. 3 is an enlarged view, partially in section, of the back of the shoe of FIG. 1 showing cleat pivot supports.

Referring now to the various figures of the drawing wherein like reference numerals refer to like parts, there is shown at 20 in FIG. 1 a shoe with retractable cleats constructed in accordance with this invention. The shoe 20 basically comprises an upper body portion 22, a sole 24, a control lever 26, control actuator arms 28A, 28B and 28C and associated components (to be discussed later), plural, e.g., eleven, cleats 30. The cleats 30 are arranged to be pivoted through respective apertures 32 (to be described later) in the sole 24 of the shoe.

Referring now to FIG. 1, it can be seen that the apertures 32 in the sole 24 are of oval shape. The sole 24 includes a ground engaging surface or tread 34.

Each cleat 30 includes a ground engaging portion or body 36 as well as other portions (to be discussed later). Each cleat 30 is of the same general construction as the other cleats and is operated in the same manner. Thus, in the interest of brevity only one of the cleats 30 will be discussed hereinafter. The rearmost or "heel" cleat 30A is located within the aperture 32A. Heel cleat 30A includes a ground engaging portion or body 36A and is of the same general construction as the other cleats. As mentioned earlier, this portion 36 is that portion of cleat 30 that projects from the shoe sole 24 to engage the ground. Each cleat 30 is made of steel and is mounted so that it pivots around a steel pin 38 horizontally mounted, transverse to the longitudinal axis of the shoe 20. (FIG. 3).

As shown in FIGS. 4*a* and 5*a*, disposed within the sole 24 is the cleat actuating assembly. This cleat actuating assembly basically comprises an upper sliding member 40 and a lower sliding member 42. The members 40 and 42 are each generally planar members and are disposed parallel to each other and to the sole 24, with a gap 44 between the members. Each pivot pin 38 for each cleat 30 is located over its corresponding oval aperture 32 by a pivot support 46 (FIG. 3) that is mounted in spaces (to be described later) in the lower sliding member 42.

An upper fixed sole layer 48 (FIGS. 2 and 4*a*) is interposed between the shoe's upper portion 22 and the upper sliding member 40 and is secured, e.g., glued, to the shoe's upper portion 22.

Figure 6A:
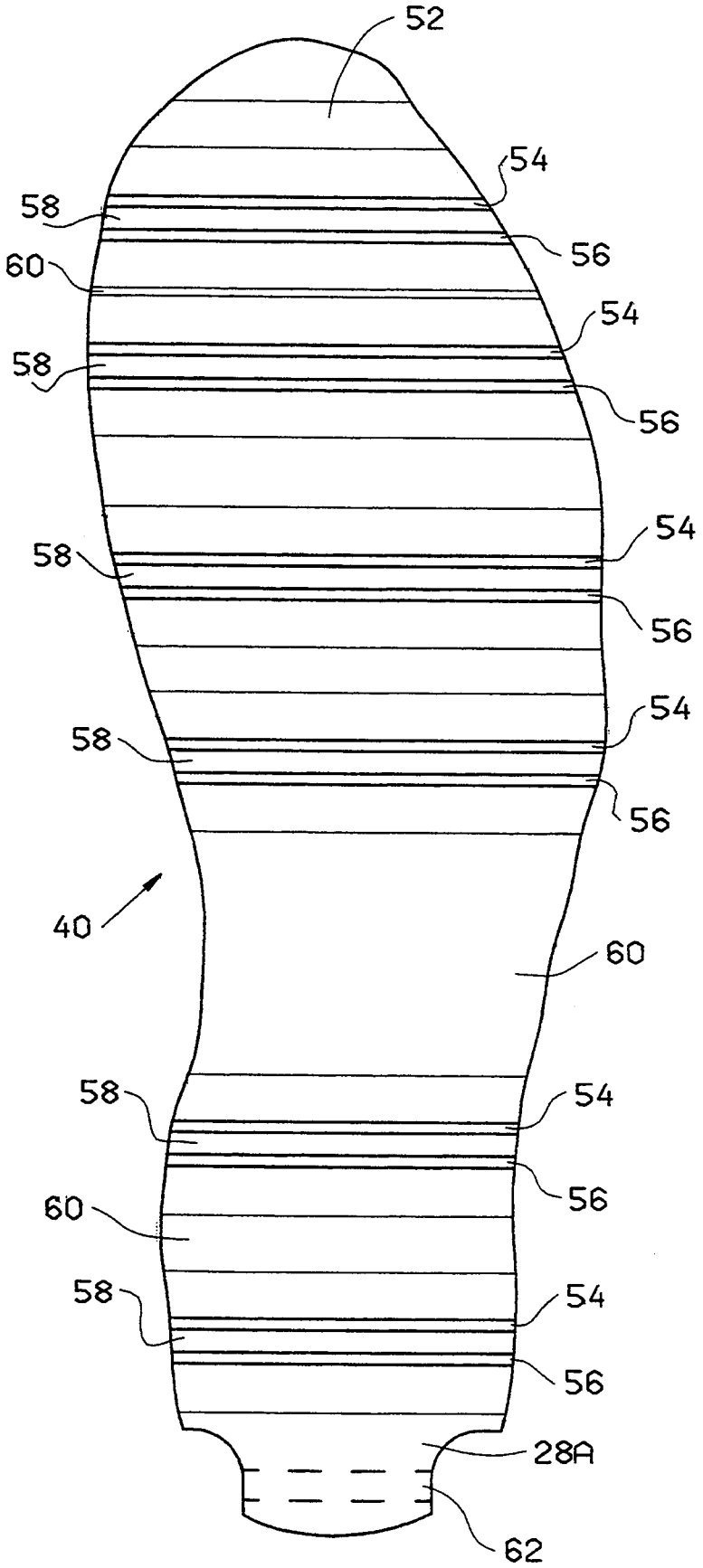
FIG. 6*a* is a bottom plan view of the bottom surface of one component of the assembly for pivoting the cleats, namely, the upper sliding member.
Figure 6B:
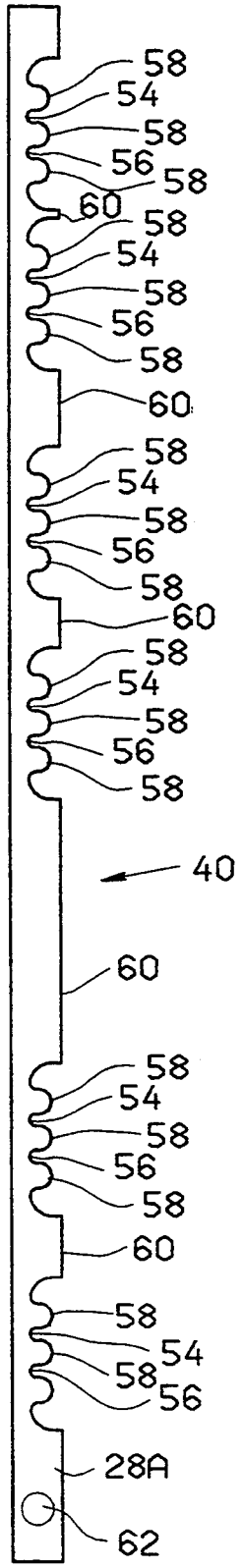
FIG. 6*b* is a side view of the upper sliding member shown in FIG. 6*a*.

The upper sliding member 40 is arranged to slide with respect to the lower sliding member 42 (as will be described later) and consists of a continuous, strong, and moldable material, e.g., acrylonitrile butadiene styrene (ABS). As can be seen clearly in FIGS. 6*a* and 6*b*, the upper sliding member 40 spans the length of the sole 24, from heel to toe. The top surface 50 (FIG. 6*b*) of the upper sliding member 40 slides against the upper fixed sole layer 48. The bottom surface 52 (FIG. 6*a*) of the upper sliding member 40 consists of alternating transverse rows of channels 54 and 56, bosses 58 and flat regions 60. The channels 54 will be referred to hereinafter as "cleat extension" channels, while the channels 56 will be referred to as "cleat retraction" channels. These channels, 54 and 56, serve to drive or pivot the ground engaging portion 36 of the cleat 30 longitudinally into and out of the aperture 32 in the sole 24, as will be described later.

The control lever actuator arm 28A also forms a portion of the cleat actuating assembly and is made up of the rear end of the upper sliding member 40. A hole 62 (FIG. 6*b*) is provided in the arm 28A to receive a connector pin 72 to pivotally connect the control actuator arm 28A to the control lever 26.

Figure 7A:
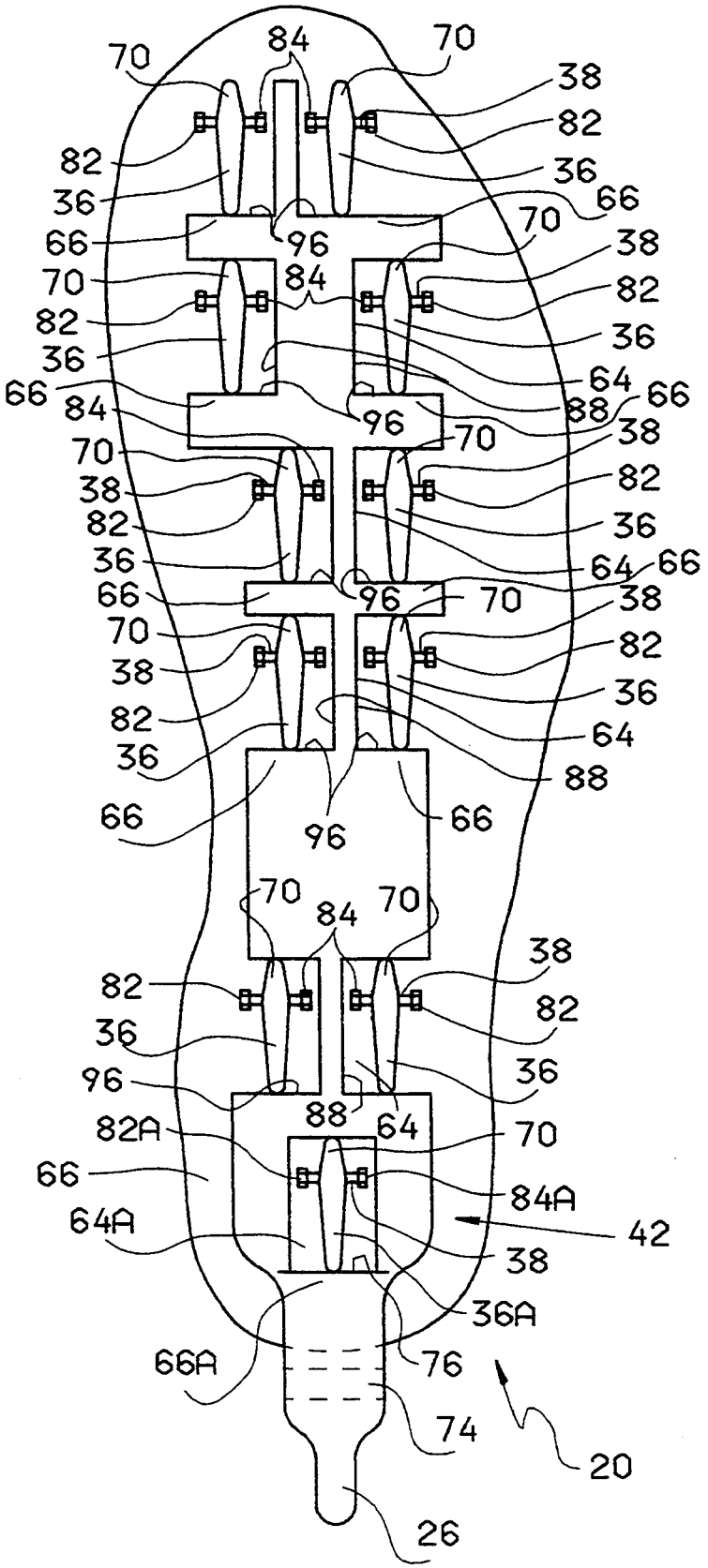
FIG. 7*a* is a bottom plan view of the bottom surface of another component of the assembly for pivoting the cleats, namely, the lower sliding member, shown with the cleats retracted.

The lower sliding member 42 also consists of a continuous element of ABS material that spans the length of the sole 24, from heel to toe (FIG. 7*a*). However, the outer periphery of this member 42 has rectangular cut-outs or recesses 64. These cut-outs 64 form the cavities into which the ground engaging portions 36 of the cleats 30 are positioned when the cleats 30 are retracted. The portions of the member 42 between the recesses 64 form the blocking segments 66. These blocking segments 66 are arranged to be moved longitudinally when the lower plate is so moved, whereupon they cover portions of the oval apertures 32 when ground engaging portions 36 are projected out of sole 24.

Figure 7B:
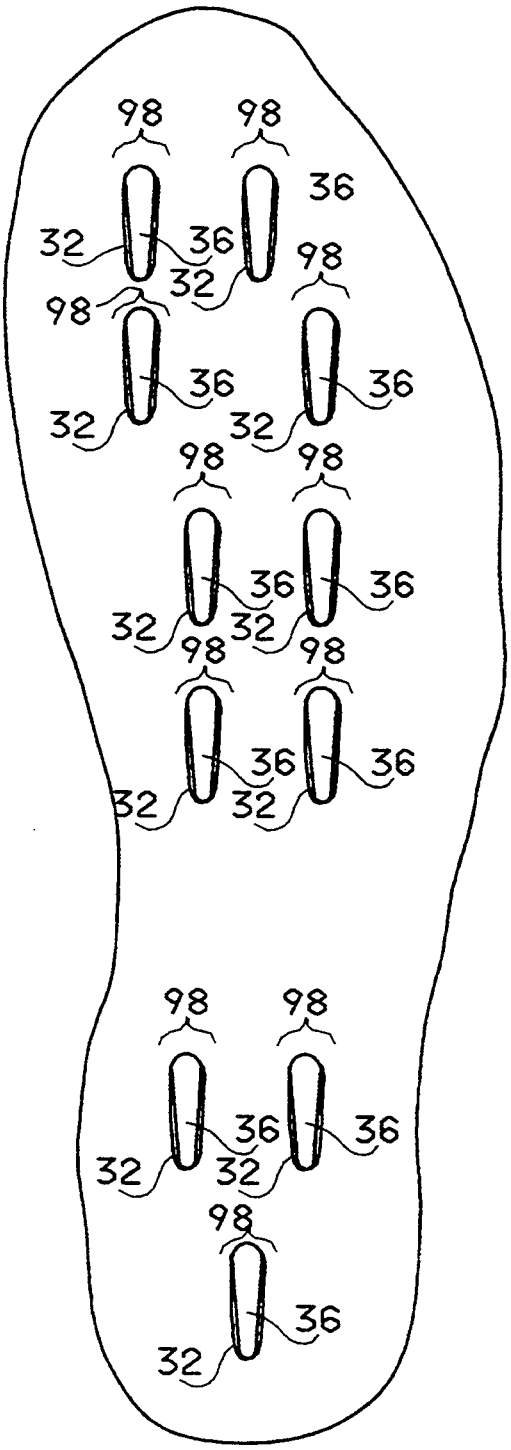
FIG. 7*b* is a bottom plan view of the shoe tread with the cleats retracted.
Figure 8A:
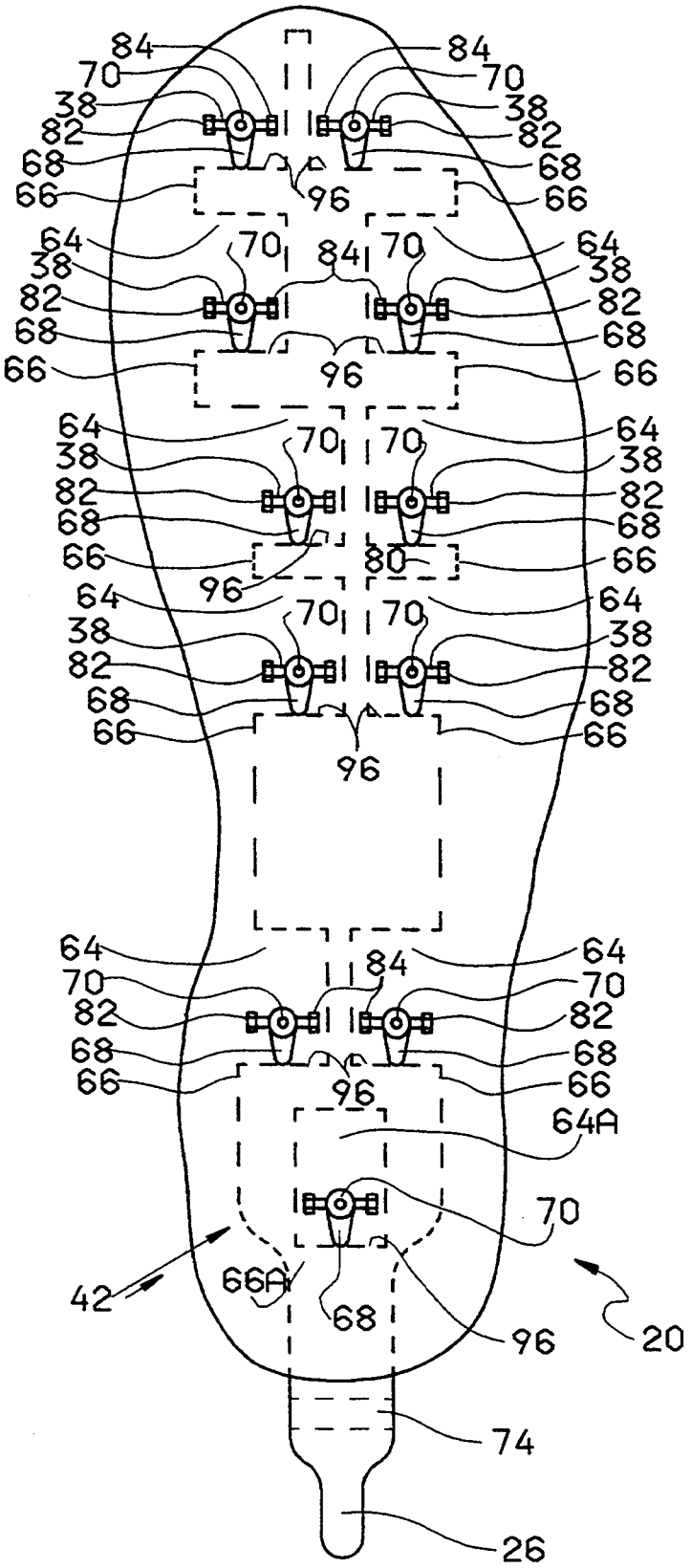
FIG. 8*a* is a bottom plan view of the bottom surface of the lower sliding member with the cleats extended.
Figure 8B:
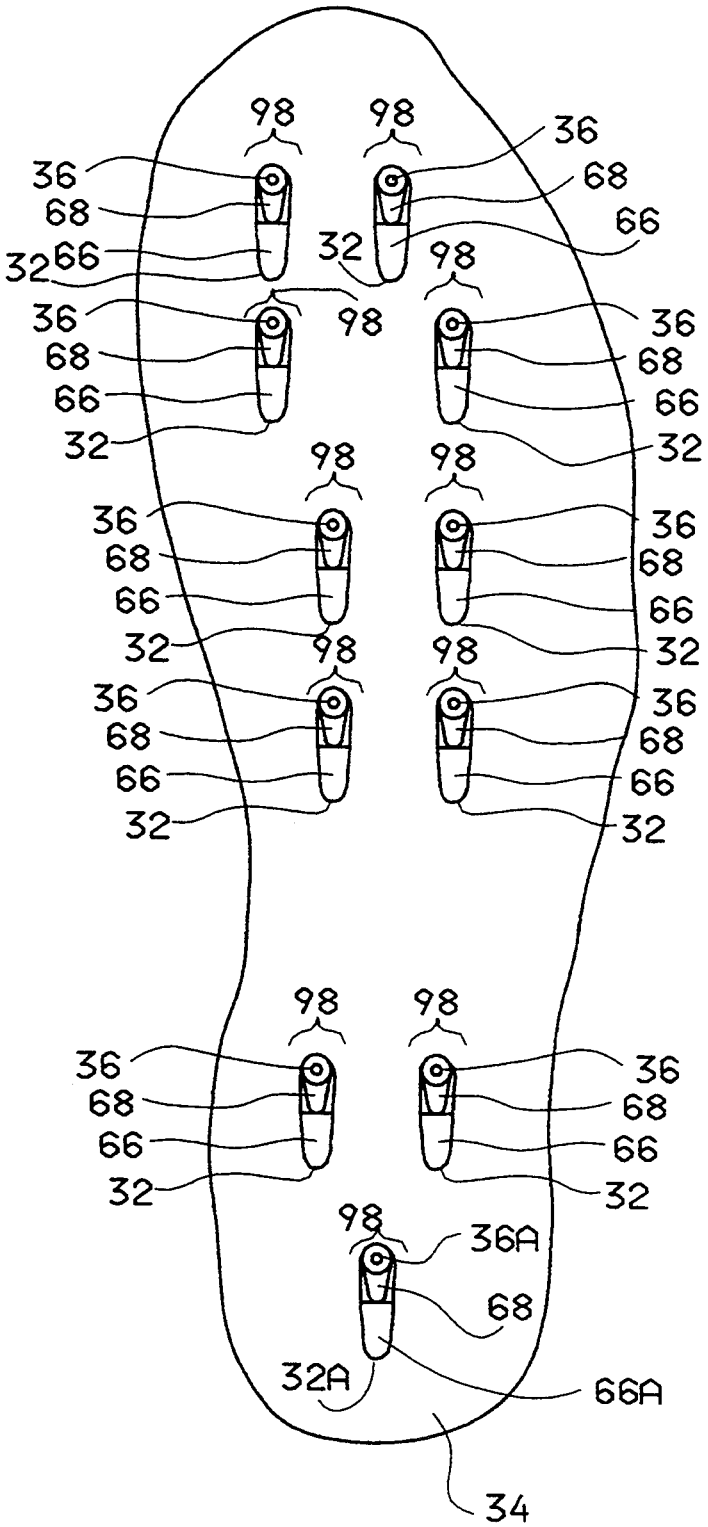
FIG. 8*b* is a bottom plan view of the shoe tread with the cleats extended.

FIGS. 7*a* and 7*b* show cleats 30 in their retracted mode wherein the cleat bodies 36 are positioned within respective cut-out portions 64, whereas FIGS. 8*a* and 8*b* show the cleats 30 in their extended mode. In that case, a cleat retraction boss 68 is in contact with a blocking segment 66. Extension and retraction of the cleats 30 will be discussed later.

Because the heel cleat 30A is not located at the periphery of the lower sliding member 42 as are the other cleats (FIG. 8*a*), an opening 64A within lower sliding member 42 provides the cavity for the heel cleat 30A only. The blocking segment 66A functions in the same manner as does the blocking segment 66, described above.

The control lever actuator arm 28C forms one end of the lower sliding member 42. A hole (not shown) is provided in control actuator arm 28C for the insertion of a connector pin 74. The lower sliding member 42 slides against the top surface 78 of the tread 34, as shown in FIGS. 4*a* and 5*a*.

The head portion 86 of the cleat 30 is disposed within the sole gap 44 (described below) by being pivotally mounted in pivot support 46. The head portion 86 has two protuberances whose peaks are perpendicular to one another. These protuberances, retraction boss 68 and extension boss 70, engage corresponding retraction 56 and extension 54 channels located in the upper sliding member 40 as the member 40 is moved longitudinally.

Figure 9:
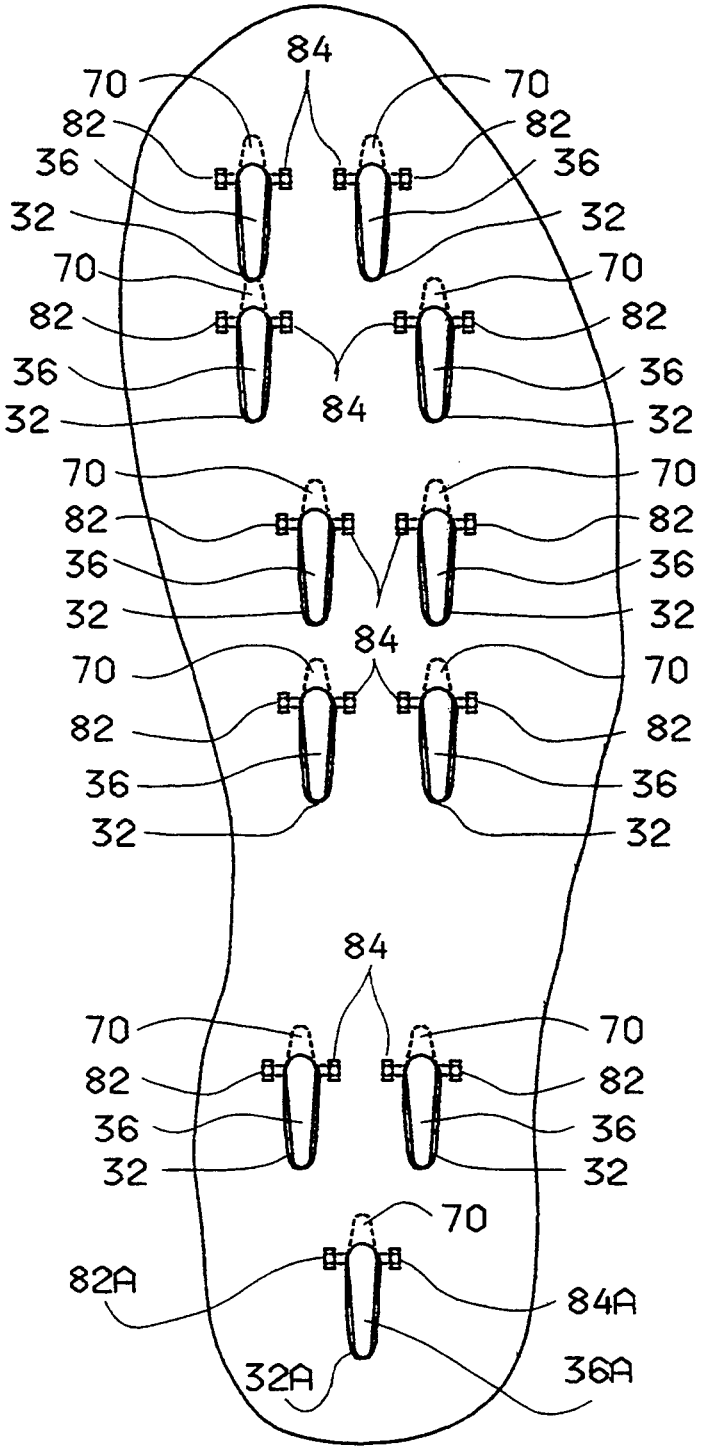
FIG. 9 is a bottom plan view of the shoe tread with the cleats retracted showing the pivot support locations phantom lines.

Each pivot support 46 consists of an outer 82 and inner 84 journal which are permanently attached to the top surface 78 of the tread 34. The steel pin 38 is the axle that extends through the cleat head 86 and whose ends are mounted in the outer 82 and inner 84 journal, respectively. As can be seen in FIGS. 7*a* and 7*b*, clearance is provided between the inner journal 84 and the inside surface 88 of the rectangular cut-outs 64. This clearance allows the lower sliding member 42 to slide forward and backward without being obstructed by the inner journal 84. The location of the outer 82 and the inner journal 84 for each cleat 30 is just over the forward end 98 of the oval aperture 32 on the top surface 78 of tread 34 (FIG. 9); this location assures that the ground engaging portion 36 of the cleat 30 will move in and out of the associated aperture 32, unobstructed, and also assures that the ground engaging portion 36 will act to block off the aperture 32 when it is retracted- The heel cleat 30A has corresponding journals 82A and 84A (FIG. 7*a*). Clearance is required on the outer side of both journals 82A and 84A due to the location of both journals within the opening 64A.

The gap 44 (FIGS. 4*a* and 5*a*) also spans the length of the sole portion 24 from heel to toe. The gap 44 is bounded on the top by the bottom surface 52 of the upper sliding member 40 and is bounded on the bottom by the top surface 80 of the lower sliding member 42. The gap 44 permits the retraction boss 68 and extension boss 70 clearance to freely move when driven by the retraction channel 56 and the extension channel 54, respectively.

The control lever 26 is mounted to the back exterior of the shoe 20 by way of the three control actuator arms, 28A, 28B and 28C. The lever 26 pivots about its axis point 90 which forms one end of the center control actuator arm 28B. The other end of the center control actuator arm 28B is molded into the sole interior. Unlike the two other control actuator arms 28A and 28C, the center arm 28B does not move. Forward pressure applied to the top of the lever 26 drives the upper sliding member 40 forward while simultaneously driving the lower sliding member 42 backwards, i.e., the sliding members work in opposition to each other: forward motion of upper sliding member 40 drives the ground engaging portion 36 upward into sole 24 while the backward motion of the lower sliding member 42 displaces the blocking segment 66 with a rectangular cut-out 64, thereby creating a cavity in the sole 24 into which the ground engaging portion 36 is positioned. Conversely, backward motion of the upper sliding member 40 drives the ground engaging portion 36 downward out of the sole 24 while the forward motion of lower sliding member 42 displaces the rectangular cut-out 64 with the blocking segment 66, eliminating the cavity while covering the oval aperture 32.

The method of driving cleat 30 (including heel cleat 30A) will now be discussed. To retract the ground engaging portion 36, the control lever 26 is moved forward, toward the toe of the shoe 20, in the direction of the arrow designated by reference numeral 92 in FIG. 4*a*. This forward motion on the upper sliding member 40 causes the extension channel 54 to engage the extension boss 70 of the cleat head 86. As the forward motion continues, the extension channel 54 pushes the extension boss 70 forward, thereby pivoting the cleat 30 about the steel pin 38. The ground engaging portion 36 of the cleat is swept upwards by this motion through the oval aperture 32 in the tread 34. Simultaneously, forward motion of the control lever 26 causes backward motion (in the direction of the arrow designated by reference numeral 94 in FIG. 4*a*) of lower sliding member 42, which action causes the blocking segment 66 to move forward and positions the rectangular cut-out 64 over the oval aperture 32, thereby creating a cavity into which ground engaging portion 36 is positioned. Continued forward motion of the upper sliding member 40 causes the retraction channel 56 to engage the retraction boss 68 which finally drives the ground engaging portion 36 of the cleat into the rectangular cut-out 64. At this point, the control lever 26 is at its most forward position. With the retraction boss 68 trapped in the retraction channel 56, cleat 30 is locked in a retracted state and its ground engaging portion 36 now acts as a barrier to foreign matter from getting into rectangular cut-out 64.

To extend the ground engaging portion 36, the reverse process is followed. In particular, the control lever 26 is pushed backward which drives the upper sliding member 40 backward, in the direction of the arrow designated as 94 in FIG.4*a*. This backward motion forces the retraction channel 56 to expel the retraction boss 68 downward, thereby driving the ground engaging portion 36 of the cleat out of rectangular cut-out 64. As this motion continues, the cleat 30 rotates about its steel pin 38 until the extension boss 70 engages the extension channel 54. Simultaneously, backward motion of the control lever 26 causes forward motion of the lower sliding member 42 which action causes the rectangular cut-out 64 to move forward and positions the blocking segment 66 over the associated oval aperture 32, thereby covering most of aperture 32. The surface 96 makes contact with the retraction boss 68 and the aperture 32 is substantially closed off, thereby preventing foreign matter from entering through aperture 32. With the control lever 26 at its most backward position, the extension boss 70 is trapped within the extension channel 54, thereby locking the cleat 30 in an extended position.

Because the upper sliding member 34 and the lower sliding member 36 are unitary, the control lever 26 commands, i.e., movements, are communicated to all of the retractable cleats 30 simultaneously.

As can be seen clearly in FIGS. 1, *7a*, *7b*, *8a*, *8b* and 9, the eleven retractable cleats 30 are grouped in transverse pairs, except for the one heel cleat 30A, which is located in the heel portion. Every transverse pair of cleats 30 shares a respective, common extension channel 54 and a respective, common retraction channel 56, as can be seen in FIG. *6a*. The heel cleat 30A does not share its extension 54 and retraction channel 56 with any other cleat. The rectangular cut-out portions 64 and the blocking segments 66 of the lower sliding member 42 are located so that all rectangular cut-outs 64 and blocking segments 66 move in unison to either make room for a retracting cleat 30 or to block oval aperture 32, respectively. The result is a shoe that has retractable cleats at the wearer's command.

One reasonably skilled in the art realizes that the use of the term "cleat" or "spike" is not intended to limit the meaning of a piece of metal that is fastened to a shoe to give secure footing. Rather, the use of the term "cleat" or "spike", in this disclosure, is interchangeable.

Without further elaboration, the foregoing will so fully illustrate the invention that others may, by applying current or future knowledge, adopt the same for use under various conditions or service.

I claim:

1. A shoe comprising sole means serving to act as the surface of said shoe upon which the wearer treads and having a plurality of apertures, a plurality of ground engaging members, and common control means, said sole means having a longitudinal axis with said plurality of apertures being located on said sole means, each of said apertures being elongated and longitudinally directed, said plural ground engaging members being located within respective ones of said apertures and pivotally mounted for movement in a first longitudinal direction to an extended position, whereupon said ground engaging members project out of said apertures to engage the ground, and for movement in a second and opposite longitudinal direction to a retracted position, whereupon said ground engaging members are located to fill at least a substantial portion of said openings from the ingress of foreign matter therein, said common control means being operative to move said plural ground engaging members in unison to either said first or second position and comprising upper and lower plates located within said sole means, lever means mounted in the heel portion of said sole means and coupled to said plates for moving said plates along said longitudinal axis, said upper plate including a pair of channels for each of said ground engaging members, said channels being operable to expel and lock or to retract and lock said ground engaging members, said lower plate being positioned to alternately provide respective cavities into which said retracted ground engaging members are locked, said lower plate serving as means for blocking each cavity vacated by as associated extended ground engaging member.

2. The shoe of claim 1 wherein its ground engaging surface has elongated longitudinally oriented apertures through which said ground engaging members can project from or recede into, with the shape of said apertures conforming to the shape of said ground engaging members.

3. The shoe of claim 1 wherein each of said ground engaging members includes a body to engage the ground and a contiguous head portion that is pivotally fixed within said sole means, said head portion having extension and retraction protuberances that are alternately engaged by adjacent recesses in said upper plate when said upper plate is displaced in either longitudinal direction.

4. The shoe of claim 3 wherein said ground engaging members are rotated by contact of upper plate with them, whereupon said plate locks said ground engaging members in either a retracted or extended position respectively, said retraction protuberances acting as part of said means for blocking whenever said retraction protuberance is not in contact with said upper plate.

5. The shoe of claim 3 additionally comprising a pivot support for each ground engaging member, said pivot support being fixed within said sole and about which said ground engaging member rotates, without said support interfering with either said upper or lower plate movement, said pivot support being fixed within said sole such that ground engaging member substantially fills said aperture when retracted.

6. The shoe of claim 5 wherein said pivot support is located such that said extension protuberance acts as part of said means for blocking whenever said extension protuberance is not in contact with said upper plate.

7. The shoe of claim 1 wherein said lower plate comprises a periphery which is shaped to provide a blocking segment over each aperture whenever said ground engaging member is extended and to displace such blocking segment whenever said ground engaging member is retracted.

8. The shoe of claim 1 wherein said lower plate includes openings therein to provide blocking segments over each aperture whenever said ground engaging member is extended and to displace such blocking segment whenever said ground engaging member is retracted.

9. The shoe of claim 1 wherein the surface of said upper plate in contact with said ground engaging member protuberances is composed of adjacent transverse channels for engaging and locking said extension protuberances of all ground engaging members simultaneously or for engaging and locking said retraction protuberances of all ground engaging members simultaneously to either extend and lock or retract and lock said ground engaging members simultaneously.

10. The shoe of claim 1 wherein one end of said upper plate and one end of said lower plate are directly coupled to an external lever arm that drives said upper plate and said lower plate in opposition to one another when force is applied thereto in either of two longitudinal directions.

11. The shoe of claim 1 wherein said upper and lower plates consist of strong, moldable and light-weight material.

* * * * *